United States Patent [19]

van Kampen

[11] Patent Number: 4,672,324

[45] Date of Patent: Jun. 9, 1987

[54] FLAME PROTECTION CIRCUIT

[75] Inventor: Jan van Kampen, Eindhoven, Netherlands

[73] Assignee: U.S. Philips Corporation, New York, N.Y.

[21] Appl. No.: 718,053

[22] Filed: Mar. 29, 1985

[30] Foreign Application Priority Data

Apr. 12, 1984 [NL] Netherlands ..... 8401173

[51] Int. Cl.[4] ..... G01M 27/00; F23N 23/00; G06G 7/12

[52] U.S. Cl. ..... 328/6; 340/577; 431/25

[58] Field of Search ..... 328/6; 340/577, 578, 340/579; 431/25, 69, 70

[56] References Cited

U.S. PATENT DOCUMENTS 4,300,099 11/1981 Maruyama ..... 328/6

4,527,125 7/1985 Miyanaka et al. ..... 328/6

*Primary Examiner*—Stanley D. Miller

*Assistant Examiner*—B. P. Davis

*Attorney, Agent, or Firm*—Robert T. Mayer; Bernard Franzblau

[57] ABSTRACT

A flame control circuit becomes a flame protection circuit when the whole circuit is also controlled with respect to correct operation. A final output signal 32, "presence of flame", is supplied only if a flame 6 is present and the circuit operates correctly. In any other case, in which parts of the circuit operate incorrectly, independently of the presence or absence of the flame, the output signal "absence of flame" is supplied. The circuit utilizes the rectifying effect of a flame on an alternating voltage applied to a measuring probe 2 in the flame, and the measuring direct voltage thus obtained, taken with an alternating voltage as a reference and applied to correctly polarized phase detection circuits 28, 42 produces the final output signal.

16 Claims, 4 Drawing Figures

FLAME PROTECTION CIRCUIT

This invention relates to a flame protection circuit having a first input terminal for a flame probe and a second input terminal for a burner bed, the circuit comprising an alternating voltage source and a parallel-combination of a resistor and a capacitor connected to the input terminals in such a manner that in the presence of a flame between the burner bed and the flame probe an ionization current flow which, because of the rectifying effect of the flame, comprises a direct current component which produces a measuring direct voltage across the capacitor. The circuit further comprises a comparison circuit having a first input connected to the said parallel-combination to compare the measuring direct voltage with a first reference value applied to a second input of the comparison circuit to produce a final output signal having a first value corresponding to a first measuring direct voltage in the absence of the flame and a second value corresponding to a second measuring direct voltage in the presence of the flame, the first reference value lying between the first and second measuring direct voltages.

Such a circuit is known from British Patent Specification No. 730,619.

The arrangements shown in FIGS. 1 and 2 of that Patent Specification comprise a comparison circuit which can be operative only in one phase of an alternating supply voltage. In this phase, the comparison circuit determines whether the measuring direct voltage is larger or smaller than the first reference value. The measuring direct voltages are obtained in the other phase and are preserved across the capacitor of the parallel-combination. If there is no flame, the first measuring direct voltage is zero and the triode V1 will convey current in one phase. If there is a shortcircuit between the probe and the burner bed, the capacitor cannot store a direct voltage so that in one phase the grid voltage of the triode is zero in FIG. 1 and is slightly positive in FIG. 2. Current then continues to flow in the triode. If there is a flame, the second measuring direct voltage is obtained, which is negative with respect to the common line 8-9-11-16, as a result of which the triode is cut off. In this case, the triode V2 will convey current representing the said second value. However, this current also flows when the grid resistance R4 of the triode V2 erroneously does not cause a sufficient voltage drop, as is the case when no current flows through R4 due to a wire rupture in the winding T2 or with too small a current through R4 when in FIG. 1 a shortcircuit between the probe 4 and the burner bed 1 has a sufficiently high resistance to produce a certain direct voltage at the capacitor C1, which is also the case for an interruption in R3. In all these cases, the fuel valve remains energized, while the flame is still absent or the flame is no longer present. This may lead to dangerous situations and for this reason the known flame protection circuit, which is therefore in fact only a flame control circuit, does not satisfy the requirements imposed on these circuits by inspection boards for combustion apparatus using continuously operating burners.

The invention provides a circuit which is self-controlling and in which phase detection possibilities are utilized to advantage. By the use of this circuit, dangerous situations as described are avoided, the final output signal having a second value, corresponding to the presence of the flame, only if the flame is indeed present and if the circuit is operating correctly, while an output signal having a first value is supplied if there is no flame and, independently of the flame, if components in the circuit do not operate at all or operate unsatisfactorily.

For this purpose, a flame protection circuit of the kind mentioned in the opening paragraph is characterized in that the comparison circuit comprises a comparator connected through its non-inverting input to the first input and through its inverting input to the second input and a synchronous detector connected to an output of the comparator and arranged to supply the said final output signal. Furthermore, a reference source is connected to the said second input and periodically switches the reference value between the first reference value and a second reference value at a frequency and a phase equal to those of the alternating voltage source. The second measuring direct voltage lies between the first and second reference values and the synchronous detector has an input for receiving a synchronization signal derived from the reference source and supplies the final output signal having the second value if the signal at the output of the comparator is in phase opposition to the reference value signal.

A very simple circuit for the safe control of a flame and of the associated measurement part is then obtained for which the said inspection boards will issue a certificate of approval.

A preferred embodiment is characterized in that the resistor of the parallel-combination comprises a voltage-dependent resistor which limits the second measuring direct voltage to a value lying between the first and second reference values. The voltage-dependent resistor may advantageously be constituted by a few diodes connected in series in the forward direction. The second measuring direct voltage then has a well defined value.

The synchronous detector can be composed of analog components, such as a sample and hold circuit and a synchronously controlled comparator. By means of a first sample and hold circuit, a voltage is held for substantially one cycle of the alternating voltage of the reference source, and has the value of the output signal of the comparator approximately halfway through the first half cycle, for which purpose the sample is taken for a short time at a time determined by the synchronization signal. By means of a second sample and hold circuit, a voltage is held which has the value of the comparator output signal approximately halfway through the subsequent half cycle, for which purpose it is also sampled for a short time. The synchronously controlled comparator can then compare, for a time shorter than a half cycle and derived from the synchronization signal, the two signals at the hold circuits and can supply only the final output signal having the second value if one hold circuit has a given signal value, for example corresponding to a defined digital value "0", while the other hold circuit has a signal value corresponding to a value "1". With other signal value combinations, the comparator supplies the first voltage corresponding to absence of the flame.

With the use of the flame protection circuit according to the invention in burner control automation, in which a microprocessor system is now being used more frequently, the synchronous detector can form part of this system because the signal values in the circuit are in fact already digital and the operation of the detector can be simply taken over by the microprocessor system.

An advantageous embodiment therefore has these features. The flame protection circuit according to the invention is further provided in two preferred embodiments, which will be described, in which attention is paid to air and creapage paths (because of the high voltage of the alternating voltage source), the location of the voltage level of the common line of the circuit with respect to the grounded burner bed, and the fact whether the circuit will be applied at a high voltage with respect to the environment.

These embodiments will be described more fully with reference to the drawings, in which.

Figure 1:
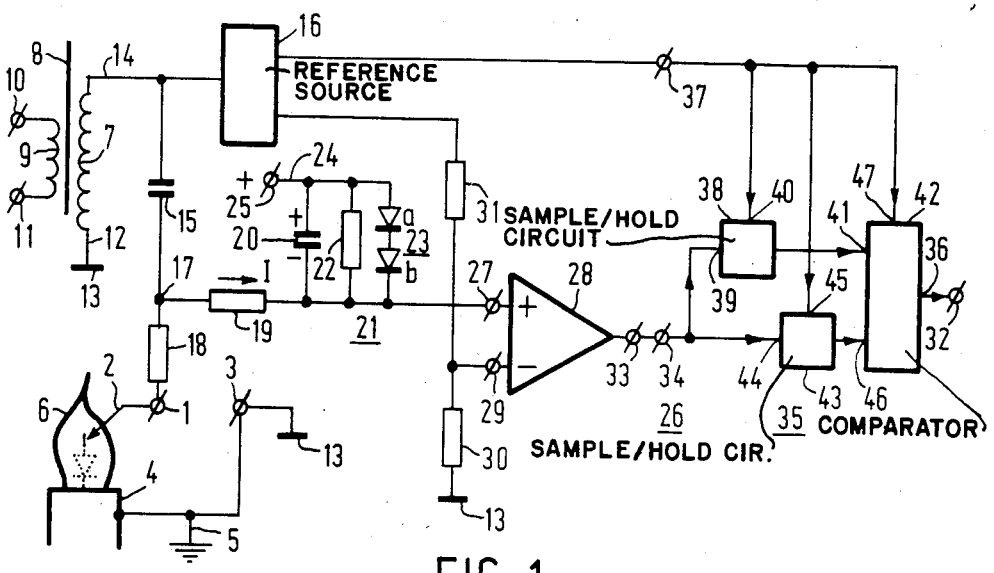
FIG. 1 shows a first embodiment.

In FIG. 1, a first input terminal 1 is connected to a flame probe 2 and a second input terminal 3 is connected to a burner bed 4, which is nearly always connected to ground 5. This burner bed 4 may be an outlet opening for the ignition flame 6, which when alight surrounds the probe 2, or may be the main flame grating, such as used in heating boilers and in large industrial burners. An alternating voltage source 7 is provided in the form of a secondary of a transformer 8, the primary 9 of which is connected via terminals 10 and 11 to AC supply mains of 50 or 60 Hz, although other sources, for example of 400 Hz, are, of course, also possible. Source 7 is connected on one end 12 to the common line 13 of the circuit and on the other end 14 to a capacitor 15 and a reference source 16. The capacitor 15 is connected to the junction 17 of two resistors 18 and 19, one of which (18) is connected to the first input terminal 1, while the other (19) is connected to a parallel-combination of a capacitor 20 and a resistor 21 comprising a resistor 22 of a normal linear character and a voltage-dependent resistor 23 comprising two series-connected diodes a and b. The other side 24 of the parallel-combination is connected to a positive voltage source 25. A comparison circuit 26 comprises a first input 27 connected to the parallel-combination 20 and 21 and to the non-inverting input of a comparator 28 and a second input 29 connected to the inverting input and to the junction of a voltage divider comprising two resistors 30 and 31 that are connected to the reference source. The reference source produces a rectangular waveform signal derived from the alternating voltage on the side 14 of source 7 and having the same frequency and the same phase. The source 16 may be an amplifier which is overdriven by the input signal. The comparison circuit has an output 32 for the final output signal which has the first value in the absence of the flame and has the second value in the presence of the flame. The output 33 of the comparator 28 is connected to the input 34 of a synchronous detector 35 having an output 36 connected to the final output 32 and an input 37 connected to the reference source 16 for receiving the synchronization signal. As stated, the synchronous detector can be included in a microprocessor system because of its digital decision character. However, in FIG. 1, the detector 35 is represented by a few functional blocks in order to illustrate the operation. A first sample and hold circuit 38 receives the signal from the input 34 and from the input 37 at its inputs 39 and 40, respectively, and derives therefrom the signal value of the output signal of the comparator 28 approximately halfway through each first half cycle. This signal value is preserved for substantially one cycle and is supplied to a first input 41 of a synchronously controlled comparator 42. A second sample and hold circuit 43 receives the said signal value from the input 34 at its input 44 and the synchronization signal at its input 45 in order to supply to the second input 46 of the comparator 42 the signal value for substantially one period shifted by a half cycle with respect to the half cycle just mentioned. At the beginning of this period a sample is taken so as to obtain and to preserve the signal value of the output signal of the comparator 28 approximately halfway through every second half cycle subsequent to the said first half cycle. From the two signals at the inputs 41 and 46, the comparator 42 decides in the time elapsing between the end of the sampling signal of the second half cycle and the subsequent sampling signal of a first half cycle, and determined by the synchronization signal at the input 47, which output signal has to be supplied via the output 36 to the final output 32, i.e. a first value for the absence of a flame or a second value for the presence of a flame.

Figure 2:
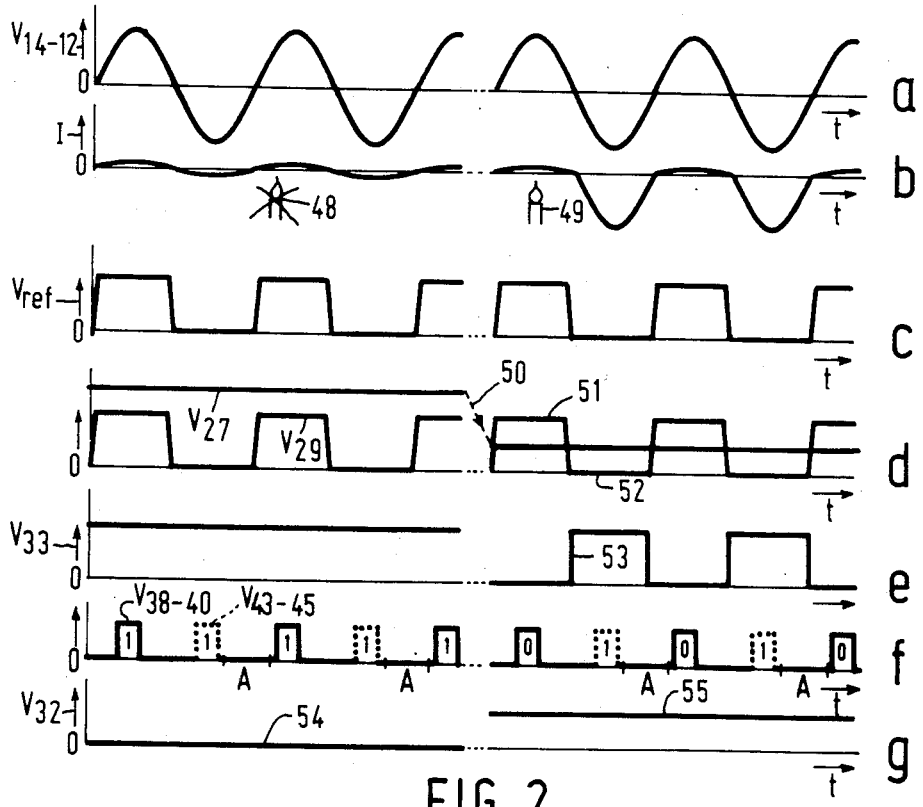
FIG. 2 shows an associated waveform diagram.

In FIG. 2, the diagrams (a) to (g) illustrate the operation of the circuit shown in FIG. 1, in which the various quantities are plotted against the time t. The diagram (a) shows the alternating voltage supplied by the transformer winding 7.

Diagram (b) shows the current I flowing through the resistor 19 in the indicated direction. In the absence of the flame, as indicated by a symbol 48, a very small alternating current flows, which substantially does not produce any alternating voltage across the capacitor 20. In the presence of a flame, as indicated by a symbol 49, current I is very small in the positive part of the alternating voltage cycle, while the capacitor 15 is charged due to the rectifying effect of the flame, as indicated in dotted outline in the flame 6. In the subsequent negative part, the capacitor voltage across the capacitor 15 and the source 7 voltage between the sides 14 and 12 are polarized in the same sense and give rise to a large negative current I, which charges the capacitor 20 with the indicated polarity.

Diagram (c) shows the reference voltage, as produced by the reference source 16.

Diagram (d) represents the input voltages at the inputs 27 and 29 of the comparison circuit 26. V27 is the measuring direct voltage which has a first value in the absence of the flame. This first value exceeds the value of the reference voltage at the input 29 and is determined by the voltage of the source 25. When the flame is ignited, the capacitor 20 is charged and the measuring direct voltage V27 is polarized in the negative sense, as indicated by an arrow 50. The voltage V27 is then lower than the first reference value 51 and is periodically exceeded at the frequency and phase of the alternating voltage source 7, via the reference source 16, by the reference voltage, which then assumes the value 52 (equal to zero). Since the first input 27 with receiver the voltage V27 and is connected to the non-inverting input "+" of the comparator 28, there is produced at its output 33 a rectangular signal which is in phase opposition to the reference value signal.

Diagram (e) illustrates this output signal V33 which is a continuous positive voltage in the absence of the flame and a rectangular signal 53 in the presence of the flame.

Diagram (f) shows sampling pulses V38–40 and V43–45. The result of the sampling of the signal V33 is indicated by "0" and "1" within the pulses. In the period A, the synchronously controlled comparator 42 compares the signals at the inputs 41 and 46 and the output 36 supplies the second value only if V41 originating from the hold circuit 38 is a "0" and V46 originating from the hold circuit 43 is a "1", while it supplies the first value with any other combination.

Diagram (g) represents these values. In the absence of the flame, the first value 54 is equal to zero, while in the presence of the flame the second value 55 is positive.

Figure 3:
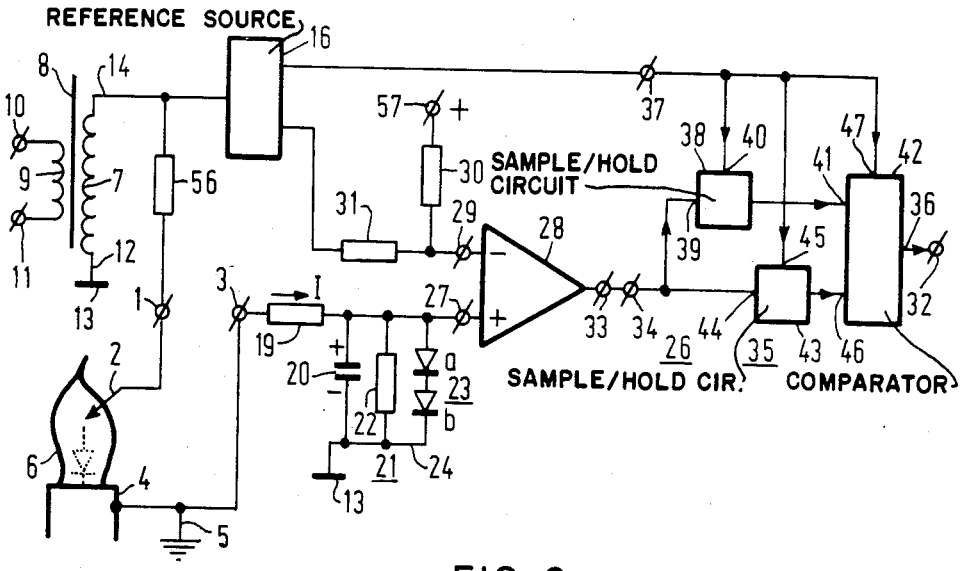
FIG. 3 shows a second embodiment.

In FIG. 3, the parts corresponding to those in FIG. 1 are designated by the same reference numerals. In FIG. 1, the common line or ground of the circuit is connected to the burner bed, which is grounded. However, a blocking capacitor 15 is then required. The circuit can be simplified, but it then floats with respect to ground. In FIG. 3, this version is shown. The side 14 of the winding 7 is connected through a limiting resistor 56 to the input terminal 1, while the input terminal 3 is now connected to the resistor 19. The parallel-combination 21 is connected at side 24 to the common line 13. The first input 27 is connected to the non-inverting input of the comparator 28 and the resistor 30 is connected to a positive voltage at the point 57. The circuit in which the ionization current flows consists of the following points and components: 13-12-7-14-56-1-2-6-4-3-19-21-24-13.

Figure 4:
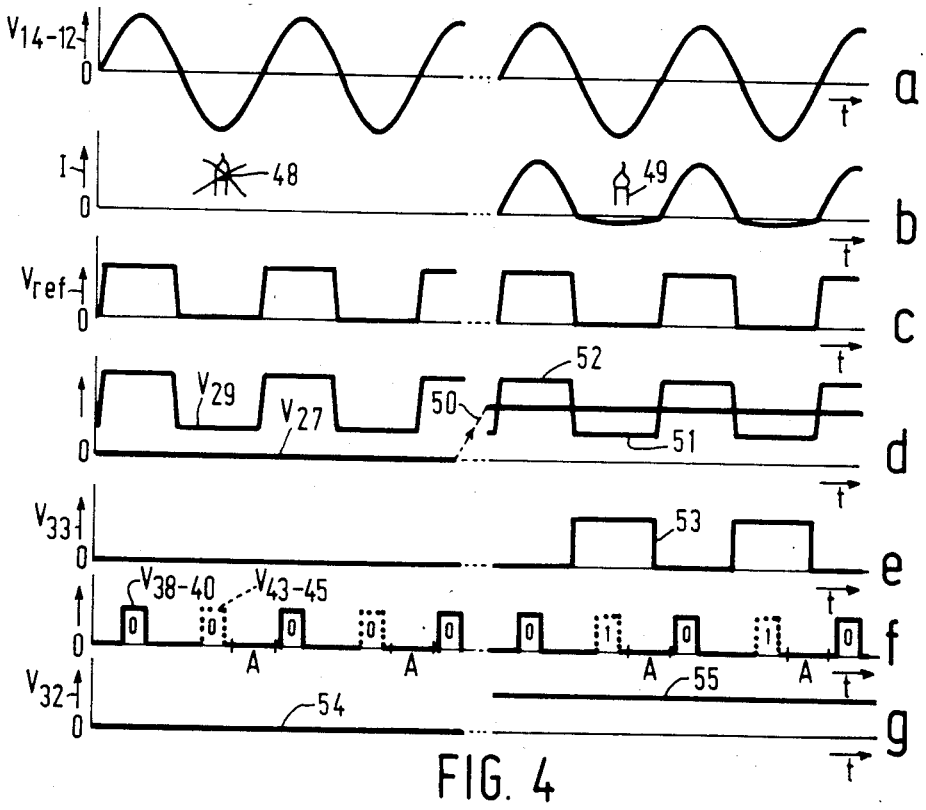
FIG. 4 shows an associated waveform diagram.

The diagrams in FIG. 4 correspond to those in FIG. 2.

Diagram (a) shows the alternating voltage between the points 14 and 12.

Diagram (b) shows the current I in the absence and in the presence of the flame. Because of the direction of the current, the capacitor 20 is charged positively.

Diagram (c) shows the reference voltage of the source 16.

Diagram (d) shows that the first measuring direct voltage V27 is zero in the absence of the flame, that at the transition between absence of a flame and presence of a flame the measuring direct voltage is polarized in the positive sense according to the arrow 50 and that the first reference value 51 is exceeded when the second measuring direct voltage is reached. This first reference value is equal to the voltage at the point 57. The second reference value 52 is again larger than the second measuring direct voltage. In this case, the output 33 supplies a rectangular signal which is in phase opposition to the reference signal Vref.

Diagram (e) shows this rectangular signal 53.

Diagram (f) illustrates the sampling pulses with the result at the hold circuit expressed in "0" and "1".

Diagram (g) shows the final output signal 54, which is zero in the absence of the flame and has the second value 55 in the presence of the flame because the unit 42 ascertained during the period A that the signal at the input 41 was "0" and the signal at the input 46 had the value "1".

It should be noted that for complete protection, the various supply voltages, as far as required, can be controlled as to shortcircuit and interruption or against too high or too low a voltage and that for the resistors in the circuit generally, so-called film resistors (spirallized) are specified, for which open circuit is the only likely fault to occur.

What is claimed is:

1. A flame protection circuit comprising a first input terminal for a flame probe and a second input terminal for a burner bed, an alternating voltage source and a parallel-combination of a resistor and a capacitor connected to the input terminals in a manner such that in the presence of a flame between the burner bed and the flame probe an ionization current flows which, because of the rectifying effect of the flame, comprises a direct current component which produces a measuring direct voltage across the capacitor, a comparison circuit having a first input connected to the said parallel-combination to compare the measuring direct voltage with a first reference voltage value applied to a second input of the comparison circuit to produce a final output signal having a first value corresponding to a first measuring direct voltage in the absence of the flame and a second value corresponding to a second measuring direct voltage in the presence of the flame, the first reference voltage values lying between the first and second measuring direct voltages, characterized in that the comparison circuit comprises a comparator having a non-inverting input connected to the first input and an inverting input connected to the second input, a synchronous detector connected to an output of the comparator and arranged to supply said final output signal, a reference signal source connected to the said second input and which periodically switches the reference value, at the frequency and phase of the alternating voltage source, between the first reference value and a second reference value, the second measuring direct voltage lying between the first and second reference values and the synchronous detector having an input for receiving a synchronization signal derived from the reference source and supplying the final output signal having the second value if the signal at the output of the comparator is in phase opposition to the reference signal.

2. A flame protection circuit as claimed in claim 1, wherein the resistor of the parallel-combination comprises a voltage-dependent resistor which limits the second measuring direct voltage to a value lying between the first and second reference values.

3. A flame protection circuit as claimed in claim 1 wherein the alternating voltage source comprises a secondary of a transformer having one side connected to the second input terminal and its other side connected through a blocking capacitor to two resistors, one of said two resistors being connected to the first input terminal and the other of said resistors being connected to the said parallel-combination, the other side of the parallel-combination being connected to a voltage supply source which is positive with respect to a common line of the flame protection circuit, said line being connected to the second input terminal, the positive voltage being greater than the first reference value and the second reference value being substantially equal to zero.

4. A flame protection circuit as claimed in claim 1 wherein the alternating voltage source comprises a secondary of a transformer having one side connected to a common line of the flame protection circuit at its other side connected via a first resistor to the first input terminal, a second resistor connected between the second input terminal and the said parallel-combination, the other side of said parallel-combination being connected to the common line, and wherein the first reference value is positive.

5. A flame protection circuit as claimed in claim 1 wherein the synchronous detector forms part of a microprocessor system.

6. A flame protection circuit as claimed in claim 2 wherein the alternating voltage source comprises a secondary winding of a tansformer having one secondary terminal connected to the second input terminal and a second secondary terminal connected via a capacitor to first and second resistors, means connecting the first resistor to the first input terminal and the second resistor to one side of said parallel-combination, means connecting the other side of the parallel-combination to a voltage supply source that is positive with respect to a common line of the flame protection circuit, said common line being connected to the second input terminal, the positive voltage being greater than the first reference value and the second reference value being substantially equal to zero.

7. A flame protection circuit as claimed in claim 2 wherein the alternating voltage source comprises a secondary winding of a transformer having one secondary terminal connected to a common line of the flame protection circuit and a second secondary terminal connected via a first resistor to the first input terminal, a second resistor connected between the second input terminal and one side of said parallel-combination, means connecting the other side of the parallel-combination to the common line, and wherein the first reference value is positive.

8. A flame protection circuit comprising: first and second input terminals for connection to a flame probe and a burner bed, respectively, a source of AC voltage, a parallel-connection of a resistor and capacitor coupled to said input terminals and to said AC voltage so as to produce a measuring direct voltage across the capacitor when a flame is present and due to the current rectifying effect of said flame, said measuring direct voltage having first and second values corresponding to the absence and presence of a flame, respectively, a source of reference voltage synchronized to the AC voltage to produce a reference voltage that varies periodically at the frequency of the AC voltage, a comparator having a first input coupled to said parallel-connection and a second input coupled to said reference voltage source for comparing the capacitor measuring direct voltage with the reference voltage to produce at its output an output DC voltage in the absence of a flame and a periodic output voltage at the frequency of the AC voltage in the presence of a flame, and a synchronous detector having input means coupled to the comparator output and to the reference voltage source to produce at its output a final output signal having a first value in the absence of a flame and a second value in the presence of a flame.

9. A flame protection circuit as claimed in claim 8 wherein the reference voltage varies periodically in amplitude between first and second voltage levels and the resistor of said parallel-connection comprises a voltage dependent resistor which limits the second value of the measuring direct voltage to a level between said first and second voltage levels.

10. A flame protection circuit as claimed in claim 8 wherein the reference voltage source supplies a periodic reference voltage to said second input of the comparator that is independent of the output voltage of the comparator.

11. A flame protection circuit as claimed in claim 8 wherein said AC voltage source includes a transformer having a secondary winding with a first terminal coupled to an input of the reference voltage source and to the first input terminal, means coupling a second terminal of the secondary winding to the second input terminal, said parallel-connection being coupled between a source of DC voltage and said first input terminal, and wherein the output voltage of said DC voltage source is greater than the output voltage of the reference voltage source.

12. A flame protection circuit as claimed in claim 8 wherein said AC voltage source includes a transformer having a secondary winding with a first terminal coupled to an input of the reference voltage source and to the first input terminal, means coupling said parallel-connection between a second terminal of the secondary winding and the second input terminal and with that terminal of the parallel-connection that is connected to the second input terminal also being connected to said first input of the comparator.

13. A flame protection circuit as claimed in claim 8 wherein the synchronous detector comprises, first and second sample and hold circuits each having a first input coupled to an output of the reference voltage source and a second input coupled to the output of the comparator, a synchronously controlled comparator having a first input coupled to said output of the reference voltage source and second and third inputs coupled to outputs of the first and second sample and hold circuits, respectively, thereby to derive said final output signal at an output of the synchronously controlled comparator.

14. A flame protection circuit as claimed in claim 8 wherein the reference voltage source produces a periodic reference voltage that is in phase with the AC voltage and said comparator produces, in the presence of a flame, a periodic output voltage in phase opposition to the periodic reference voltage.

15. A flame protection circuit as claimed in claim 8 wherein the synchronous detector produces a final output signal having said first value if one or more circuit components are defective and independently of the presence or absence of a flame.

16. A flame protection circuit as claimed in claim 8 wherein the resistor of said parallel-connection comprises a voltage dependent resistor comprising one or more series connected diodes.

* * * * *